United States Patent [19]

Holmes

[11] Patent Number: 4,633,977

[45] Date of Patent: Jan. 6, 1987

[54] MANUAL OVERRIDE CONTROL HANDLE SELECTIVELY ENGAGEABLE WITH THE VALVE SPOOL OF A SERVO VALVE

[75] Inventor: William K. Holmes, Delafield, Wis.

[73] Assignee: Hi-Ranger, Inc., Waukesha, Wis.

[21] Appl. No.: 762,628

[22] Filed: Aug. 5, 1985

[51] Int. Cl.[4] ..... B66B 9/20

[52] U.S. Cl. ..... 187/9 R; 212/160; 251/290

[58] Field of Search ..... 187/9 R, 1 R, 28 R; 251/290, 289, 130, 297; 137/625.62, 625.6; 182/141; 212/160, 164, 159

[56] References Cited

U.S. PATENT DOCUMENTS

| | | | |
|---|---|---|---|
| 2,892,612 | 6/1959 | Georgieff | 251/289 |
| 2,932,978 | 4/1960 | Newbery | 251/130 |
| 2,946,196 | 7/1960 | Myers | 60/54.5 |
| 2,980,391 | 4/1961 | Hill | 251/130 |
| 2,984,116 | 5/1961 | Johnson | 251/297 |
| 3,269,412 | 8/1966 | Badke | 251/297 |
| 3,311,128 | 3/1967 | Taylor | 251/98 |
| 3,373,843 | 3/1968 | Schmiel et al. | 251/289 |
| 3,515,250 | 6/1970 | Cantalupo | 251/130 |
| 3,737,140 | 6/1973 | Toth | 251/14 |
| 3,891,182 | 6/1975 | Schwerin | 251/297 |
| 4,011,891 | 3/1977 | Knutson et al. | 137/625.62 |
| 4,049,235 | 9/1977 | Singleton | 251/297 |
| 4,195,551 | 4/1980 | Schmiel | 91/358 |
| 4,285,496 | 8/1981 | Coles | 251/130 |

FOREIGN PATENT DOCUMENTS

| | | | |
|---|---|---|---|
| 665510 | 9/1926 | France | 251/289 |

*Primary Examiner*—H. Grant Skaggs
*Assistant Examiner*—Kenneth Noland

[57] ABSTRACT

A hydraulic control valve including an override control lever and an improved construction for selectively connecting the control lever to the valve spool. The control lever is selectively connected to the valve spool such that, during normal operation of the control valve, the control handle is disconnected from the valve spool, and the valve spool is freely movable and without frictional resistance of the control handle. The control lever can be moved into engagement with the valve spool such that movement of the control lever causes a consequent movement of the valve spool.

6 Claims, 5 Drawing Figures

MANUAL OVERRIDE CONTROL HANDLE SELECTIVELY ENGAGEABLE WITH THE VALVE SPOOL OF A SERVO VALVE

FIELD OF THE INVENTION

The present invention is directed to servo valves and to control handles for use in providing manual control of a valve spool.

BACKGROUND PRIOR ART

Hydraulic control valves of the type normally operated by application of hydraulic pressure at opposite ends of a valve spool commonly also include a control handle or lever for use in manually controlling the position of the valve spool and thereby overriding the pilot valves commonly used as the primary valve control mechanism.

An example of the use of such control handles is in valves used to control movement of an articulated boom of an aerial lift. Aerial lifts commonly include three or more control valves controlling the supply of hydraulic fluid to hydraulic cylinders and hydraulic motors. These hydraulic cylinders and hydraulic motors are used to control the movement of the articulated boom. The control valves are normally mounted at the base of the boom, and a control device is mounted in the operator's bucket. The operator uses the control device to control pilot valves in turn controlling operation of the control valves. The pilot valves control the delivery of hydraulic fluid to the opposite ends of the valve spools of the control valves and control the relative position of the valve spools.

It is also necessary to provide a means for controlling the bucket position from the ground, and this means must be capable of overriding the control lever in the bucket. In the event the control handle in the bucket jams or malfunctions, an operator on the ground can control movement of the bucket by manipulation of the override control handle at the control valve. The override control must also permit the operator to accurately control the position of the bucket. One of the prior art arrangements for use in providing an override control for a hydraulic control valve includes a control handle pivotally connected to the control valve and operably connected to the valve spool to move with the valve spool. Such an override control is illustrated in the Myers U.S. Pat. No. 2,946,196, issued July 26, 1960. In other valve arrangements, a rack and pinion is provided for operably connecting a control lever to the valve spool. In other similar override control levers, the control handle and valve spool are connected such that there is lost motion between the valve spool and the control lever. With override control valves of the type shown in Myers or including a rack and pinion arrangement, during normal operation of the control valve, movement of the valve spool causes consequent movement of the override control lever. Movement of the valve spool is impeded by frictional resistance in the control lever mechanism and by inertia of the mass of the control handle. This resistance or friction limits accurate control of the hydraulic control valves during normal operation of the valves.

While those arrangements having a lost motion connection between the valve spool and the control handle do not generate frictional forces resisting movement of the valve spool, the lost motion arrangements do not permit the operator sufficient control over the articulated boom when the control valves are being operated by the override control lever.

Attention is also directed to the Schmiel U.S. Pat. No. 4,195,551, issued Apr. 1, 1980; the Singleton U.S. Pat. No. 4,049,235, issued Sept. 20, 1977; the Knutson et al. U.S. Pat. No. 4,011,891, issued March 15, 1977; and the Schwerin U.S. Pat. No. 3,891,182, issued June 24, 1975.

Attention is further directed to the Toth U.S. Pat. No. 3,737,140, issued June 5, 1973; the Badke U.S. Pat. No. 3,269,412, issued Aug. 30, 1966; the Johnson U.S. Pat. No. 2,984,116, issued May 16, 1961; the Cantalupo U.S. Pat. No. 3,515,250, issued June 2, 1970; the Taylor U.S. Pat. No. 3,311,128, issued Mar. 28, 1967; the Newberry U.S. Pat. No. 2,932,978 issued Apr. 19, 1960; the Coles U.S. Pat. No. 4,285,296, issued Aug. 25, 1981; and the Hill U.S. Pat. No. 2,980,391, issued Apr. 28, 1961.

SUMMARY OF THE INVENTION

The present invention provides an improved hydraulic control valve including an override control lever or handle and an improved means for connecting the control lever to the valve spool. The control lever is selectively connected to the valve spool such that, during normal operation of the control valve wherein the valve spool is controlled by application of hydraulic pressure to cylinders at opposite ends of the valve, the control lever is disconnected from the valve spool, and the valve spool is freely movable and without frictional resistance of the control handle. When the control lever is disconnected from the valve spool, since there is no frictional resistance provided by the control lever, the valve spool is more responsive to the controls in the bucket, and the operator in the bucket has more precise control over the position of the bucket.

The means for selectively providing a connection between the override control lever and the valve spool also includes means for causing engagement of the control lever with the valve spool in response to initial manual movement of the control lever from a first position to a second position and whereby subsequent movement of the control lever causes controlled movement of the valve spool, and wherein the valve spool is freely movable with respect to the control lever unless there is manual movement of the control lever from the first position to the second position.

Various other features and advantages of the invention will be apparent by reference to the following description of a preferred embodiment, to the claims, and to the drawings.

Figure 1:
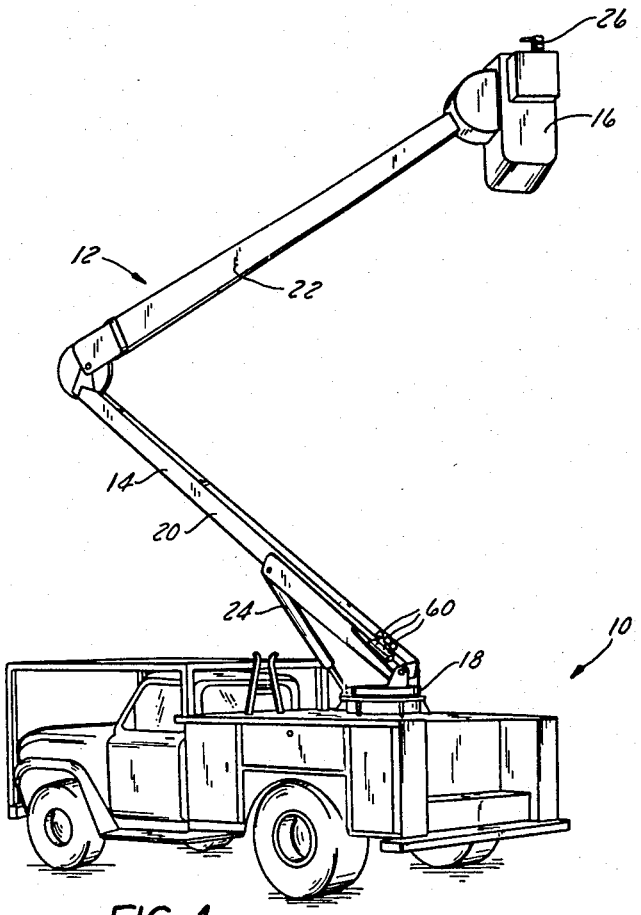
FIG. 1 is a perspective view of a utility truck supporting an aerial lift including a control valve arrangement embodying the present invention.
Figure 2:
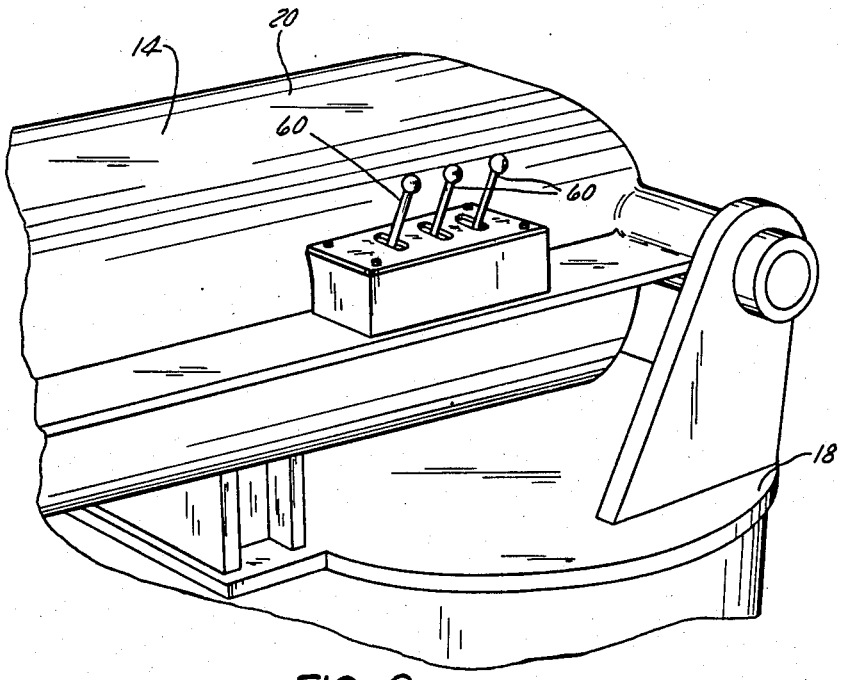
FIG. 2 is an enlarged partial perspective view of apparatus illustrated in FIG. 1.

Before describing at least one embodiment of the invention in detail, it is to be understood that the invention is not limited in its application to the details of construction and to the specific steps set forth in the following description or illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF A PREFERRED EMBODIMENT

Figure 3:
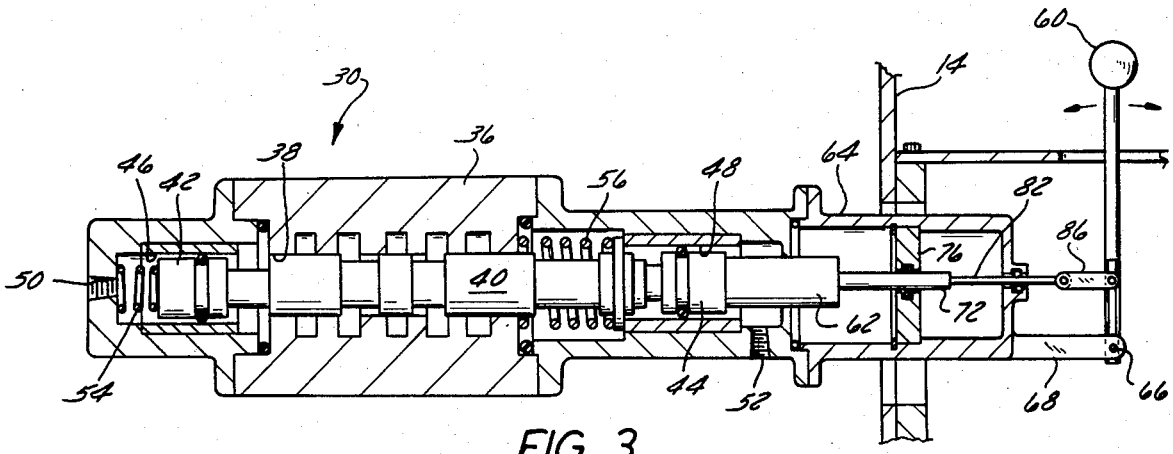
FIG. 3 is an enlarged cross section elevation view of one of the control valves of the apparatus illustrated in FIG. 2.

Illustrated in FIG. 1 is a truck 10 supporting an aerial lift 12, the aerial lift including an articulated boom 14 supporting a bucket 16 adapted to carry an operator. The articulated boom 14 is supported by a turntable 18 for rotation about a vertical axis. The articulated boom 14 includes a first beam 20 pivotally joined at its lower end to the turntable 18 and having an upper end supporting a second beam 22. The upper end of the second beam supports the bucket 16. A conventional hydraulic motor (not shown) is provided for causing rotation of the articulated boom 14 about a vertical axis of the turntable 18. A hydraulic cylinder 24 is supported by the turntable 18 and is pivotally joined at its upper end to the beam 20 to cause selective vertical movement of the upper end of the beam 20. A second hydraulic cylinder (not shown) is supported by the upper end of the beam 20 and is operably connected in a conventional manner to the beam 22 to cause movement of the beam 22 with respect to beam 20 and thereby cause vertical movement of the bucket 16 supported by the beam 22. As is conventional, a control handle 26 is mounted in the bucket 16 and is operably connected to three hydraulic valves 30, one of which is illustrated in FIG. 3. The control valves 30 control the rotary hydraulic motor, the first hydraulic cylinder 24, and the second hydraulic cylinder.

While the three hydraulic control valves 30 could be supported in various ways, and could be mounted on the truck 10, in the illustrated arangement the control valves 30 are mounted in a conventional manner at the base of the beam 20 and adjacent the turntable 18.

One of the control valves 30 is illustrated in cross section in FIG. 3 and is shown as including a valve body 36 having a central valve bore 38 housing a reciprocably movable valve spool 40. Means are also provided for causing selective movement of the valve spool 40 in the valve bore 38 in response to movement of the control handle 26. While various means could be provided for controlling movement of the valve spool 40, in the illustrated construction, opposite ends of the valve spool 40 form pistons 42 and 44 and are housed in cylinders 46 and 48, respectively, provided in the opposite ends of the valve body 36. A first fluid port 50 admits pilot hydraulic fluid to the cylinder 46, and a second fluid port 52 admits pilot hydraulic fluid to the other cylinder 48. As is conventional, the fluid ports 50 and 52 are operably connected to the control handle 26 in the bucket 16 such that movement of the control handle 26 controls the supply of hydraulic fluid to the fluid ports 50 and 52 and thereby controls movement of the valve spool 40. A pair of centering springs 54 and 56 are also provided to bias the valve spool 40 toward a central neutral position.

Means are also provided for manually controlling the control valves 30 and for overriding the operation of the control handle 26 in the bucket. It is important that a control means be provided such that the operator on the ground can control the position of the bucket 16. It is also important that this control means be capable of overriding the control handle 26 in the bucket 16 in the event that the control handle 26 malfunctions or becomes jammed, and that the means for manually controlling the control valves 30 provide for precise control of the bucket position. The means for manually controlling the control valve 30 and for overriding the operation of the control handle 26 includes a control lever 60 selectively engageable with the valve spool 40 and operable to permit an operator to manually control the position of the valve spool and to override the effect of hydraulic fluid pressure supplied to the cylinders 46 and 48.

Figure 4:
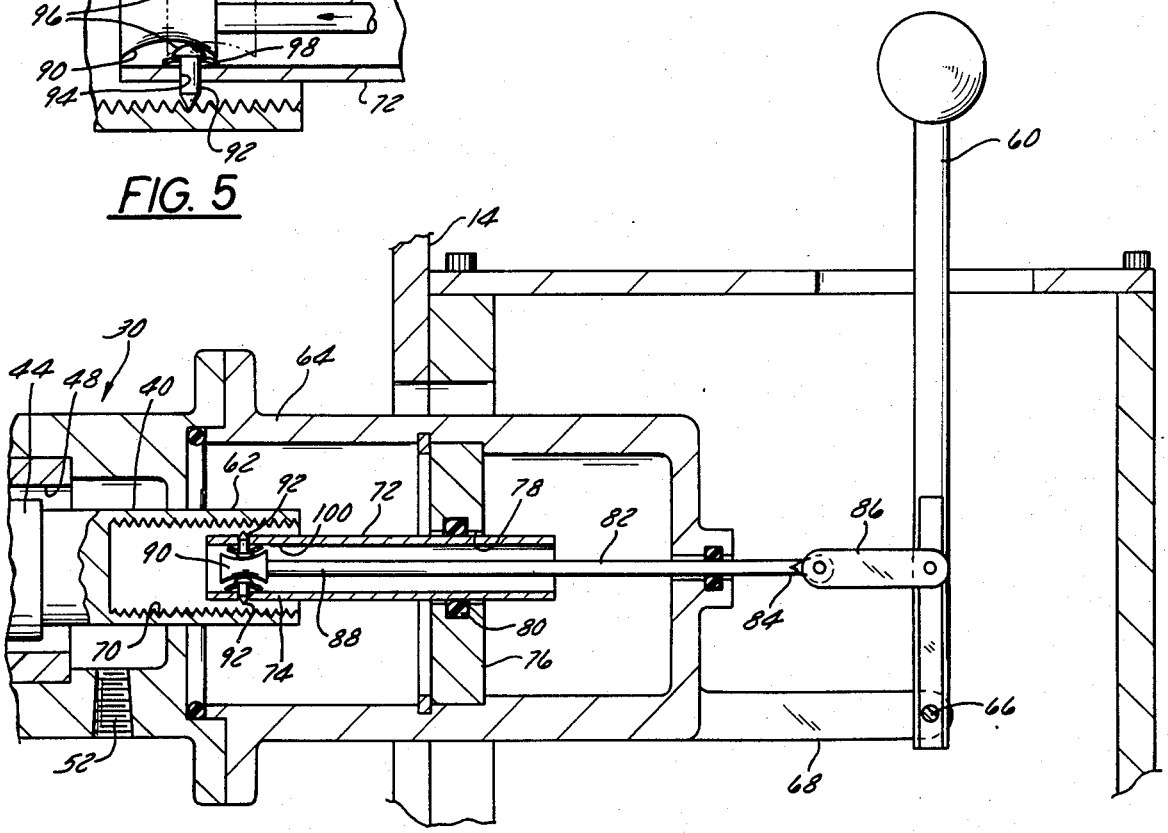
FIG. 4 is an enlarged partial view of the apparatus shown in FIG. 3.

One of the control levers 60 is illustrated in FIGS. 3–4 and is supported for pivotable movement between a first position wherein the control lever 60 is not connected to the valve spool 40 and wherein the valve spool is freely movable independently of the control lever 60 and a second position wherein the control lever 60 is operably connected to the valve spool 40 such that further pivotal movement of the control lever 60 can cause linear movement of the valve spool 40.

While in other arrangements the control lever 60 could be selectively connected to the valve spool 40 in other ways, in the illustrated arrangement, the valve spool 40 includes a valve spool extension 62 projecting from one end of the valve spool and housed in a valve body extension 64 for reciprocal movement therein.

Means are also provided for supporting the control lever 60 for pivotal movement between a disengaging position and a valve spool engaging position. The means for supporting the control lever 60 also supports the control lever for further pivotal movement to cause linear movement of the valve spool 40. While the control lever 60 could be supported in other ways, in the illustrated arrangement, the control lever 60 is pivotally supported at its lower end by a pin 66 in turn supported by an integral portion 68 of the valve body extension 64.

Means are also provided for selectively causing engagement or connection between the control handle 60 and the valve spool extension 62 in the event of initial movement of the control handle 60. In the illustrated arrangement the valve spool extension 62 includes a central bore 70 having threads or machined grooves. A sleeve 72 includes one end 74 housed in the bore 70 of the valve spool extension 62. Means are also provided for supporting the sleeve 72 for linear movement with the valve spool 40 in the direction of movement of the valve spool. In the particular arrangement illustrated in the drawings, the means for supporting the sleeve 72 includes a collar 76 housed in the valve body extension 64 and including a central bore 78 slideably housing the sleeve 72 for slideable movement. An O-ring seal 80 is housed in the bore 78 and functions to provide frictional resistance to movement of the sleeve 72.

Figure 5:
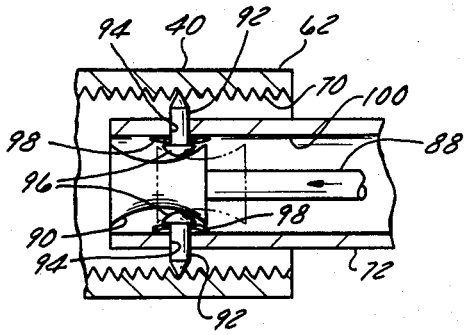
FIG. 5 is an enlarged partial view of apparatus shown in FIG. 4.

A connecting rod 82 is centrally housed in the sleeve 72 and includes one end 84 connected by a link 86 to a lower end of the control handle 60 but in spaced relation from the pivot pin 66. The end 88 of the connecting rod 82 housed in the sleeve defines a cam surface 90. A pair of pins 92 are housed in bores 94 in the free end of the sleeve 72 and are movable radially outwardly with respect to the longitudinal axis of the sleeve 72 between a position as shown in FIG. 4 to a position as shown in FIG. 5 wherein the outer ends of the pins 92 engage the threads of the central bore 70. The radially inner ends 96 of the pins 92 ride on the cam surface 90, and the cam surface 90 has a configuration such that in the event the rod 82 moves in the direction of its longitudinal axis with respect to the sleeve 72, the pins 92 will be forced radially outwardly into engagement with the threads in the central bore 70 of the valve spool extension 62.

In the particular arrangement of the invention illustrated in the drawings, means are also provided for biasing the pins 92 radially inwardly and away from engagement with the threaded central bore 70 of the valve spool, and so that the valve spool 40 is freely movable with respect to the control handle 60. While various means could be provided for biasing the pins 92 away from engagement with the central bore 70 of the valve spool extension 62, in the specific construction illustrated, spring washers 98 surround each of the pins 92 and are positioned between the internal surface 100 of the sleeve 72 and the heads 96 of the pins 92.

In operation of the apparatus embodying the invention, as the control handle 60 is moved in either direction from its neutral position shown in FIG. 4, the initial movement of the control handle 60 will cause movement of the cam surface 90 with respect to the sleeve 72, thereby causing outward movement of the pins 92 into engagement with the internal surface of the central bore 70 of the valve spool extension 62. Any additional movement of the control handle 60 will then cause linear movement of the sleeve 72 and the valve spool 40, and the control handle 60 can then be used to manually override control of the valve 30.

Various features of the invention are set forth in the following claims.

I claim:

1. A hydraulic control valve comprising a valve body having a valve bore and a plurality of hydraulic fluid ports communicating with said valve bore, and said valve bore having opposite ends, a main valve control spool housed in said valve bore and supported therein for linear reciprocal movement to control hydraulic fluid flow through said fluid ports, first means for controlling the position of said main valve control spool in said valve bore, said first means for controlling including a first spool position control means operably connected to one end of said valve bore, a second spool position control means operably connected to an opposite one of said ends of said valve bore, and means for controlling said first and second spool position control means, and manual valve control means for selectively engaging said main valve control spool for controlling the position of said main valve control spool in said valve bore, said manual valve control means including a control lever, said control lever being supported for movement with respect to said valve body, and means for selectively providing a connection between said control lever and a portion said main valve control spool such that manual movement of said control lever with respect to said valve body causes controlled linear movement of said main valve control spool, said means for selectively providing a connection between said control lever and a portion of said main valve control spool including means for causing engagement of said control lever with said valve spool in response to initial manual movement of said control lever from a neutral position to a second position and whereby subsequent movement of said control handle causes controlled movement of said valve spool, and said valve spool being freely movable with respect to said control lever unless there is manual movement of said control lever from said neutral position to said second position, said control lever including one end adapted to be engaged by the operator and a movable portion movable between a first position wherein said movable portion engages said main valve spool to provide a connection between said control lever and said main valve spool to cause movement of said valve spool in response to movement of said one end of said control handle, and a second position wherein said movable portion is disengaged from said main valve spool and said main valve spool is freely movable with respect to said control lever.

2. A hydraulic control valve as set forth in claim 1 and further including a first valve means operably connected to one end of said valve bore for supplying hydraulic fluid to said one end of said valve bore and a second valve means operably connected to an opposite end of said valve bore for supplying hydraulic fluid to said opposite end of said valve bore.

3. An aerial lift comprising a frame, a support structure supported by the frame for pivotal movement about a vertical axis, a first elongated boom having opposite ends, means for pivotally joining one of said opposite ends of said first elongated boom to said support structure, a second elongated boom having opposite ends, one of said ends of said second elongated boom being pivotally connected to the other of said opposite ends of said first elongated boom, the other of the opposite ends of the second elongated boom supporting a platform for use in supporting a workman, a hydraulic cylinder connected to the support structure and to the first elongated boom for causing selective pivotal movement of the first boom with respect to the support structure, means for controlling operation of said hydraulic cylinder, said means for controlling including a hydraulic control valve operably connected to said hydraulic cylinder, said hydraulic control valve including a valve body having a valve bore and a plurality of hydraulic fluid ports communicating with said valve bore, and said valve bore having opposite ends, a main valve control spool housed in said valve bore and supported therein for linear reciprocal movement to control hydraulic fluid flow through said fluid ports, first means for controlling the position of said main valve control spool in said valve bore, said first means for controlling including a first spool position control means operably connected to one end of said valve bore, a second spool position control means operably connected to an opposite one of said ends of said valve bore, and means for controlling said first and second spool position control means, and manual valve control means for selectively engaging said main valve control spool for controlling the position of said main valve control spool in said valve bore, said manual valve control means including a control lever, said control lever being supported for movement with respect to said valve body, and means for selectively providing a connection between said manual control lever and a portion of said main valve control spool such that movement of said manual control lever with respect to said valve body causes controlled linear movement of said main valve control spool, said means for selectively providing a connection between said control lever and a portion of said main valve control spool includes means for causing engagement of said control handle with said valve spool in response to initial manual movement of said control lever from a first position to a second position and whereby subsequent movement of said control handle causes controlled movement of said valve spool, and said valve spool being freely movable with respect to said control lever unless there is manual movement of said control lever from said first position to said second position.

4. An aerial lift as set forth in claim 3 wherein said control lever includes one end adapted to be engaged by the operator and a movable portion movable between a first position wherein said movable portion engages said main valve spool to cause movement of said valve spool in response to movement of said one end of said control handle and a second position wherein said movable portion disengages said main valve spool whereby said main valve spool is freely movable with respect to said control handle.

5. An aerial lift as set forth in claim 4 and further including a first valve means operably connected to one end of said valve bore for supplying hydraulic fluid to said one end of said valve bore and a second valve operably connected to an opposite end of said valve bore for supplying hydraulic fluid to said opposite end of said valve bore.

6. A manual valve control apparatus for use with a hydraulic control valve including a valve body having a valve bore, a plurality of hydraulic fluid ports communicating with said valve bore, and a valve spool positioned in the valve bore and supported therein for linear reciprocal movement to control hydraulic fluid flow through the hydraulic fluid ports, first means for controlling the position of said main valve control spool in said valve bore, said first means for controlling including a first spool position control means operably connected to one end of said valve bore, and a second spool position control means operably connected to an opposite one of said ends of said valve bore, and means for controlling said first and second spool position control means, and the manual control apparatus comprising:

means for selectively engaging the valve spool for controlling the position of the valve spool in the valve bore, the means for selectively engaging including a manually movable control lever, said manually movable control lever being supported for movement with respect to said valve body, and means for selectively providing a connection between said manually movable control lever and said main valve control spool such that movement of said manually movable control lever causes controlled linear movement of said valve spool, said means for selectively providing a connection between said manually movable control lever and a portion of said main valve control spool includes means for causing engagement of said manually movable control lever in response to initial manual movement of said manually movable control lever from a first position to a second position and whereby subsequent movement of said manually movable control handle causes controlled movement of said valve spool, and said valve spool being freely movable with respect to said control lever unless there is manual movement of said manually movable control lever from said first position to said second position, said control handle including one end adapted to be engaged by the operator and a movable portion movable between a first position wherein said means for causing engagement engages said main valve spool to cause movement of said valve spool in response to movement of said one end of said control handle and a second position wherein said movable portion is disengaged from said main valve spool and said main valve spool as freely movable with respect to said control handle.

* * * * *